United States Patent [19]

Köhnert et al.

[11] 4,129,309

[45] Dec. 12, 1978

[54] AUSTENITIC CAST IRON

[75] Inventors: Hans J. Köhnert, Esslingen; Herbert Smetan, Schorndorf, both of Germany

[73] Assignee: Mahle GmbH, Stuttgart, Germany

[21] Appl. No.: 802,550

[22] Filed: Jun. 1, 1977

[30] Foreign Application Priority Data

Jun. 18, 1976 [DE] Fed. Rep. of Germany ..... 2627329

[51] Int. Cl.[2] ..... B65D 53/00; F16J 9/22; C22C 37/10

[52] U.S. Cl. ..... 277/189.5; 75/124; 75/125; 148/35

[58] Field of Search ..... 148/35; 75/123, 125, 75/124, 128 A, 128 C, 128 D, 128 T; 428/653; 277/189.5

[56] References Cited

U.S. PATENT DOCUMENTS 3,330,651 7/1967 Younkin ..... 148/35

FOREIGN PATENT DOCUMENTS 406942 7/1971 U.S.S.R. ..... 75/124
460323 6/1973 U.S.S.R. ..... 75/124

OTHER PUBLICATIONS

"Constituent Elements in Steel and Cast Fe." Shield Alloy Corp., 1/1944, p. 69.

*Primary Examiner*—Arthur J. Steiner
*Attorney, Agent, or Firm*—William Anthony Drucker

[57] ABSTRACT

This invention provides an austenitic cast iron especially suitable for reinforcements in aluminium pistons and containing 2–6% Ni, 1.8 to 4.0% C, 1–3% Si, 6–12% Mn, 5–7% Cu, less than 0.08% Cr, 0.3 to 2% Al and 0.05 to 0.3% Ti.

3 Claims, No Drawings

AUSTENITIC CAST IRON

The purpose of the invention is to provide an austenitic cast iron with the following properties:-

(a) Thermal expansion coefficient of between $16.0 \times 10^{-6}$ and $21.0 \times 10^{-6}$ 1/ $_{deg}$ at 20°-100° C.

(b) Good wear resisting and strength properties, in accordance with specification of alloy GGL-NiCuCr 15 6 2 (DIN 1694).

(c) Good intermetallic bonding with aluminium alloys with bonding strengths of over 50 N/mm2.

(d) The following machining properties: the static and dynamic main cutting forces are to be within a range known in connection with GGL-NiCuCr 15 6 2 or only slightly in excess thereof. Similarly, the proportion of hard constituents (carbides) must not be appreciably higher, so that similar periods of service life can be adhered to for the tools with which they are machined.

(e) Good castability, the following requirements being met in the case of GGL-NiCuCr 15 6 2: the tendency to cavitation, the tendency to the formation of oxide film, the flow properties and the tendency to white irradiation are to be within a range known from GGL-NiCuCr 15 6 2.

In particular, the alloy must be capable of being used in centrifugal casting.

(f) Sufficient austenite stability, i.e. the alloy, after thermal treatment of at least 300 hours at 300° C., is to show no austenite disintegration phases. Furthermore, the alloy is to show no austenite disintegration during briefer thermal treatments at high temperatures (up to 8 hours at 500° C.), during the build-up of an iron aluminite layer or during the pouring process.

An alloy of this kind is eminently suitable, for example, for a workpiece to be wholly or partly poured or pressed into a light metal material or shrunk on to it. By light metal in this connection are meant, in particular, aluminium and its alloys. The alloy is a particularly advantageous material, for instance, for reinforcements of annular grooves (by so-called ring carriers) in light metal pistons of combustion engines. For ring supports of this kind are either poured or pressed into the piston and must ensure a firm seating in the light metal material, under very high stresses.

Alloys which fulfil the aforementioned requirements are already known *per se* in the prior art.

By way of an example, mention should be made of the GGL-NiCuCr 15 6 2 hereinafter called Alloy A and having a composition of:

2.4–2.8% C, 1.8–2.4% Si, 1.0–1.4% Mn, p1 13.5–17.0% Ni, 1.0–3.0% Cr, 5.0–7.0% Cu.

This alloy, however, suffers from the drawback of being relatively expensive, owing to its comparatively high Ni content. The same applies to the alloy which is known from British Pat. No. 558,182 and of which the nickel content is at least about 8% and, when used for the purpose to which the invention relates, at least about 12%.

For this reason, alternative alloys with a lower Ni content were already proposed at an earlier stage. An example is provided by German Pat. No. 683699. This relates to an austenitic cast iron, hereinafter called Alloy B, of the following composition:

2.5–3.5% C,
2.0–5.0% Si, 4.0–12.0% Mn,
1.5–8.0% Ni,
0.0–10.0% Co.

The material coming within this range of alloys and hereinafter referred to as Alloy C has attained greater importance, inter alia as a material for ring supports in light metal pistons, its composition being as follows:

2.7–3.2% C,
2.7–3.9% Si,
9.5–12% Mn,
<0.008% Si,
0.2–0.4% Cr,
5.0–6.0% Ni,
<0.3% Cu

This material has the following properties:
Hardness: 170–220 kp/mm2 HB 30/5.
Tensile strength: 180–220 N/mm2.
Elasticity modulus: 100,000–120,000 N/mm2.
Thermal expansion coefficient;
25°–100° C.: $17.5 \times 10^{-6}$ 1°/C.
25°–200° C.: $18.6 \times 10^{-6}$ 1°/C.
25°–300° C.: $19.1 \times 10^{-6}$ 1°/C.
25°–400° C.: $19.3 \times 10^{-6}$ 1°/C.
Specific gravity: 7.4 p/cm$^3$.
Thermal conductivity: 0.05 cal/cm × sec × °C.

Particularly when used as a component inserted in light metal, e.g. a ring support, this material suffers from the following drawbacks:

High degrees of hardness and the necessity of consequently high cutting forces in the machining; serious wear on tools, owing to the large quantities of hard constituents in the structure (cementite content up to 5% permissible).

This is shown, first and foremost, by a direct comparison with Alloy A:

| | Alloy A: | Alloy C: | |
|---|---|---|---|
| Hardness HB 30: | 120–160 | 170–220 | kp/mm2 |
| Tensile strength: | 145–180 | 180–220 | N/mm2 |
| Formation of graphite: | Type A(E)4+5 | Type A+B | 3–5 According to ASTM |
| Basic structure: | Austenite Quantity of carbide: up to 2% | Austenite Quantity of carbide: up to 5% | |

The purpose of the invention covered by the main patent resides in the provision of an alloy with a lower Ni content than Alloy A and with properties given at the beginning under (a)–(f).

The purpose of the reduction in the Ni content is to render the material less expensive, and this applies, in particular, to a comparison of the alloy with Alloy A and with that covered by British Patent No. 558182.

According to one aspect of the invention we provide an austenitic cast iron with a thermal expansion coefficient of between $16.0 \times 10^{-6}$ and $21.0 \times 10^{-6}$ 1/ deg: between 20° and 100° C. and with wear resisting and strength properties according to GGL-NiCuCr 15 6 2, characterized by the following composition:

More than 6.0 to less than 8.0% Ni,
1.5 to 4.0% C,
0.5 to 4.0% Si,
4.0 to 14.0% Mn,
0.3 to 7.0% Cu,
less than 2.0% Cr,
0.3 to 8.0% Al,
0.1 to 0.5% Ti, the rest consisting of Fe with the impurities caused by the manufacturing process.

According to a modification of that aspect of the invention the alloy has the composition:

0.1 to 6.0% Ni,
1.5 to 4.0% C,
0.5 to 4.0% Si,
6.0 to 14.0% Mn,
2.0 to 7.0% Cu,
less than 0.3% Cr,
0.3 to 8.0% Al,
0.1 to 0.5% Ti,
the rest consisting of Fe with the impurities caused by the manufacturing process.

Within this composition we find the following composition particularly suitable:-

2.0 to 6.0% Ni,
1.8 to 4.0% C,
1.0 to 3.0% Si,
6.0 to 12.0% Mo,
5.0 to 7.0% Cu,
less than 0.08% Cr,
0.3 to 2.0% Al,
0.05 to 0.3% Ti,
the rest consisting of Fe with the impurities caused by the manufacturing process.

Another particularly suitable composition is as follows:

3.5 to 4.0% Ni,
2.8 to 3.4% C,
2.0 to 2.2% Si,
8.5 to 9.5% Mn,
5.0 to 5.5% Cu,
less than 0.08% Cr,
0.3 to 2.0% Al,
0.1 to 0.15% Ti,
the rest consisting of Fe with the impurities caused by the manufacturing process.

The most important factor in the invention is that the nickel content selected is low enough to ensure that is reduction will result in a genuine saving of cost by comparison with similar alloys and that the requirements arising with cast irons according to the present application will nevertheless be completely fulfilled.

As regards the composition of alloy, with a nickel content of between 0.1 and 6%, it should be noted that the reduction thereby effected in the nickel content might result, if there were no alteration to the proportions of the remaining constituents of the alloy, in a lower austenite stability in the cast iron. By the higher minimum quantity indicated for Mn, however, it has proved possible, if necessary, to counteract this factor. A higher Mn content, it is true, will result, in its turn, in a greater tendency to the undesirable "white solidification." This, however, can be remedied by the higher Cu content indicated and by reducing the upper limit of the Cr content.

In the composition of the alloy having 2.0 to 6.0 Ni, particular importance is attached to satisfactory castability. For this purpose the Al content is lowered to a maximum of 2%. To avoid undesirable "white solidification" in the alloy, the content of Ti is optimalized at 0.05–0.3%. The reason why "white solidification" is undesirable is that it detracts from the workability of the alloy. The optimum Ti content indicated leads to a Cr content which must be below 0.08%. Owing to the low Al content it is necessary, for the maintenance of the "grey solidification" characteristics (for the sake of satisfactory workability), for the further elements Ni, Cu and Si to be optimalized likewise. The lower limit of C has likewise been raised, in order to ensure satisfactory castability and workability in the alloy.

The fourth specified alloy is specifically optimalized for use of austenitic cast iron in ring supports for light metal pistons.

A material with the alloy composition according to the fourth alloy will possess, for instance, the following mechanical properties:

Tensile strength: — 150–310 N/mm2
Elastic limit: — 125–250 N/mm2
Breaking elongation: — 1.0–2.0%
Hardness HB 30: — 120–180 kp/mm2

On the structure the following details can be given: the formation of the structure is comparable with that of Alloy A. In the austenitic matrix, only a few carbides are included, in uniform distribution. The graphite formation can be classified, according to the ASTM series for guidance, under Type A (E), Size 4–5. In the case of the sample examined, the alloy had been treated, prior to the casting, with 0.3% inoculation agent with a Ca content. According to the particular inoculation agent and technique adopted, and according to the requirements arising, different forms of graphite structure can be adopted, e.g. globular graphite.

The following further characteristics regarding the material may be given:

E modulus: — 75,000–110,000 N/mm2 (measured dynamically)
Thermal expansion (2°–100° C.): 16.5–17.5 $\times 10^{-6}$ m/m deg.
Thermal conductivity: — 0.065–0.070 cal/cm sec deg.
Density: — 6.9 kg/cm2
Compressive strength: — 1200–1500 N/mm2

As regards alloy constituents which have most effect on the desired properties for the material, the following further details may be given:

Aluminium:

Al was added mainly because of its highly graphitizing effect, in order to ensure that the carbide formation, normally commencing with 6% Mn, would only take place at higher proportions of Mn. It is true that a graphitizing effect could also be obtained by means of an increased addition of Si. By comparison with the corresponding addition of Al, however, this would worsen the austenite stability. This is due to the simultaneous highly ferritizing effect of the Si, which increases the temperatures of the eutectic conversion.

Manganese:

If the Ni content is absent or lower, the addition of Mn ensures the required adequate austenite stability. The Mn content defined in the invention provides a certain optimum in respect of the properties mentioned under (a)–(f) at the beginning.

Nickel:

The Ni content indicated is first and foremost important for the machining properties of the alloy; otherwise, the Ni content could be kept lower.

Copper:

In the Cu range defined in the invention the austenite stability reaches a maximum.

Chromium and titanium:

Proportions of Cr above 0.08%, owing to their noticeable carbide-forming characteristics, have a disadvantageous effect on the machinability of the material. The effect of Cr in this connection is a catalytic one.

Titanium:

In small proportions, titanium is an element with a high graphite-forming effect. This effect, in the case of about 0.1% titanium, reaches a maximum, then recedes, reverting to the initial level at about 0.5%. In the case of the manganese-austenitic cast irons to which the invention relates, proportions of titanium of between 0.1 and 0.15% have been found to be the optimum. Titanium is capable of neutralizing the catalytic effect of small quantities of chromium.

An example of the production of an alloy in accordance with the invention is given below:-

The following were melted in an induction furnace, in the quantities given, which in each case refer to the finished alloy, and in the compositions indicated:

30% ingot material with 3.84% C, 2.20% Si, 0.40% Mn, 0.01% P, 0.02% S.

30% crude iron in pig form with 3.90% C, 2.30% Si, 0.90% Mn, 0.02% P, 0.07% S.

15.5% steel scrap with 0.40% C, 0.33% Ci, 0.65% Mn.

These raw melts were then given the following additions in the order indicated:

8.0% ferro-manganese with 6.50% C, 0.8% Si, 76.00% Mn, rest Fe.

6.0% electrode copper with 99.9% Cu.

6.5% nickel pellets with 99.9% Ni.

1.5% ferro-titanium with 10.0% titanium and 2.0% Al, rest Fe.

When the superheating temperature of 1520° C. is reached, a thermal analysis is carried out and the C content brought to the desired final value by the addition of 0.4% carbon granules. The liquid temperature in this case is about 10° C. above the solid temperature. An addition of 2.0% pure aluminium in pig form is then given. After about 5 minutes and with a furnace temperature of 1500° C. the contents of the furnace are transferred to a casting ladle and treated with 0.5% inoculation agent (75% Si, 0.1% Ca, 0.8% Sr, 0.5% Al) in the form of grains of 1-6mm in size, and cast at about 1430° C. by a centrifugal casting process. The chemical analysis of the alloy thus produced is as follows: 3.19% C, 1.55% Si, 6.58% Mn, 6.55% Ni, 6.00% Cu, 2.21% Al, 0.18% Ti, 0.02% P, 0.02% S.

The mechanical properties of this material in the cast state are as follows:-

Hardness HB 30: — 174-186 kp/mm2.

Tensile strength: — 410 N/mm2.

Elastic limit: — 290 N/mm2.

Breaking elongation: — 0.8%.

Elasticity modulus: — 128000 N/mm2.

Thermal expansion: — $18.5 \times 10^{-6}$ 1 /deg at 20°-200° C.

Another example of the production of an alloy according to the invention is given below:-

The following were melted in an induction furnace, in the quantities given, which in each case refer to the finished alloy, and in the composition indicated:

30% ingot material with 3.35% C, 2.25% Si, 0.75% Mn, 0.35% Ni, 0.15% Cu, <0.01% Cr, 0.01% P, 0.02% S.

30% crude iron in pig form with 3.90% C, 2.30% Si, 0.90% Mn, 0.02% P, 0.07% S.

15% steel scrap with — 0.40% C, 0.33% Ci, 0.65% Mn.

These raw melts were then given the following additions, in the order indicated:

11.1% ferro-manganese with 6.50% C, 0.8% Si, 76.00% Mn, rest Fe.

0.9% ferro-silicon with 75% Si, rest Fe.

5.45% electrode copper with 99.9% Cu.

3.89% nickel pellets with 99.9% Ni.

1.5% ferro-titanium with 10.0% titanium and 2.0% Al, rest Fe.

When the superheating temperature of 1520° C. is reached, a thermal analysis is carried out and the C content brought to the desired final value by the addition of 0.35% carbon granules. The liquid temperature in this case is about 10° C. above the solid temperature. An addition of 1.5% pure aluminium in pig form is then given. After about 5 minutes and with a furnace temperature of 1500° C. the contents of the furnace are transferred to a casting ladle and treated with 0.5% inoculation agent (75% Si, 0.1% Ca, 0.8% Sr, 0.5% Al) in the form of grains of 1-6mm in size, and cast at about 1430° C. by a centrifugal casting process. The chemical analysis of the alloy thus produced is as follows: 3.26% C, 2.27% Si, 8.79% Mn, 4.0% Ni, 5.30% Cu, 1.53% Al, 0.12% Ti, 0.02% P, 0.03% S.

The mechanical properties of this material in the cast state are as follows:

Hardness HB 30: — 160-180 kp.

Tensile strength: — 270 N/mm2.

Elastic limit: — 180 N/mm2.

Breaking elongation: — 1.7%.

Elasticity modulus: — 83000 N/mm2.

Thermal expansion: — $17.5 \times 10^{-6}$ 1/ deg at 20°-200° C.

We claim:

1. Austenitic cast iron consisting of the following composition:

2.0 to 6.0% Ni,
1.8 to 4.0% C,
1.0 to 3.0% Si,
6.0 to 12.0% Mn,
5.0 to 7.0% Cu,
less than 0.08% Cr,
0.3 to 2.0% Al,
0.05 to 0.3% Ti, the rest consisting of Fe with the impurities caused by the manufacturing process.

2. Austenitic cast iron consisting of the following composition:

3.5 to 4.0% Ni,
2.8 to 3.4% C,
2.0 to 2.2% Si,
8.5 to 9.5% Mn,
5.0 to 5.5% Cu,
less than 0.08% Cr,
0.3 to 2.0% Al,
0.1 to 0.15% Ti, the rest consisting of Fe with the impurities caused by the manufacturing process.

3. An aluminium or aluminium base alloy piston having an annular groove containing a reinforcement made of cast iron in accordance with claim 1.

* * * * *